United States Patent [19]

Milovic

[11] Patent Number: 4,854,592

[45] Date of Patent: Aug. 8, 1989

[54] GOLF CLUB WITH INTERNAL SAND RAKE

[76] Inventor: Alex J. Milovic, 9501 Florence Cir., Villa Park, Calif. 92667

[21] Appl. No.: 249,410

[22] Filed: Sep. 26, 1988

[51] Int. Cl.[4] ..... A63B 53/00

[52] U.S. Cl. ..... 273/162 F; 273/162 E; 172/378; 294/2

[58] Field of Search ..... 273/162 F, 162 E, 162 R, 273/32 R, 32 B, 32 F; 172/380, 379, 378, 381

[56] References Cited

U.S. PATENT DOCUMENTS

| | | | |
|---|---|---|---|
| 1,686,323 | 10/1928 | Von Der Heyde | 273/162 E |
| 2,739,331 | 3/1956 | Goodman | 273/162 F |
| 3,210,111 | 10/1965 | Fallon | 294/19.2 |
| 3,698,720 | 10/1972 | Gudmundsen | 273/162 E |
| 3,771,794 | 11/1973 | Crockett | 273/162 F |
| 3,833,223 | 9/1974 | Shulkin | 273/194 R |
| 3,870,300 | 3/1975 | Amendola | 273/32 B |
| 4,216,831 | 8/1980 | Ritchie | 172/380 |
| 4,289,344 | 9/1981 | Mitchell | 294/2 |
| 4,674,747 | 6/1987 | Mazzocco et al. | 273/81.2 |
| 4,799,684 | 1/1989 | Rango | 273/162 F |

FOREIGN PATENT DOCUMENTS

| | | | |
|---|---|---|---|
| 2073563A | 10/1981 | United Kingdom | 294/2 |

*Primary Examiner*—George J. Marlo

*Attorney, Agent, or Firm*—Kelly, Bauersfeld & Lowry

[57] ABSTRACT

A collapsible sand rake assembly may be stored within the shaft of a golf club and selectively extended from an upper end of the club for use. The sand rake assembly includes a post which has a limited range of sliding movement with respect to the golf club, a rake back which is pivotally connected to the post, and a plurality of tines which are pivotally connected to the rake back. The rake back may be pivoted to extend perpendicualr to the post, and likewise the tines may be pivoted to extend perpendicular to the rake back, to configure the golf club for use as a sand rake by the golfer. The tines and the rake back may then be retracted to lie substantially parallel and adjacent to the post, for insertion within the shaft. The sand rake assembly is held within the golf club shaft in a manner which minimizes contact between the assembly and the shaft, to permit normal use of the golf club.

23 Claims, 2 Drawing Sheets

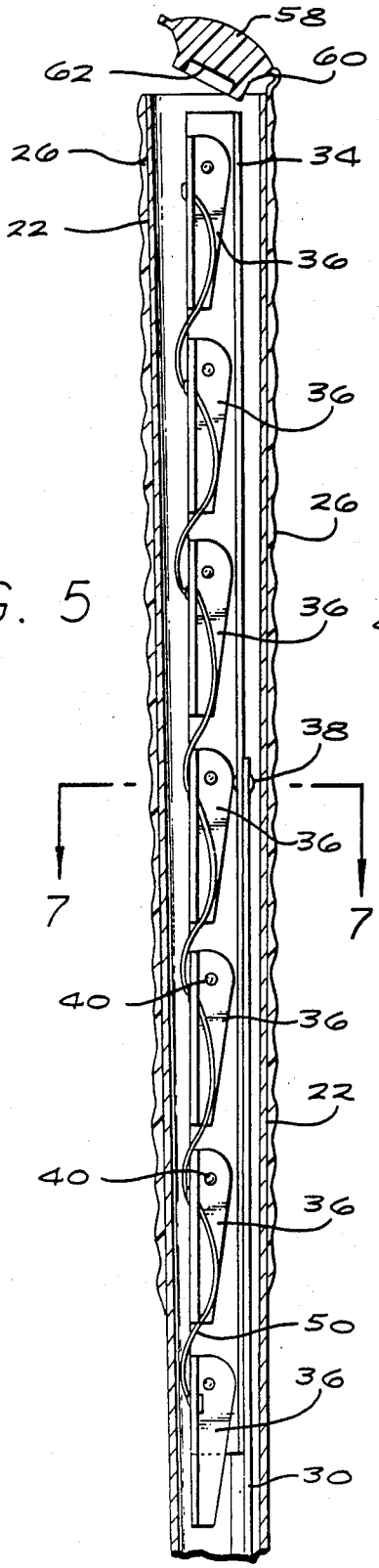
FIG. 5
FIG. 6
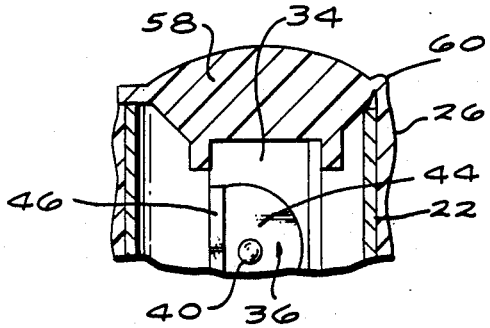
FIG. 7
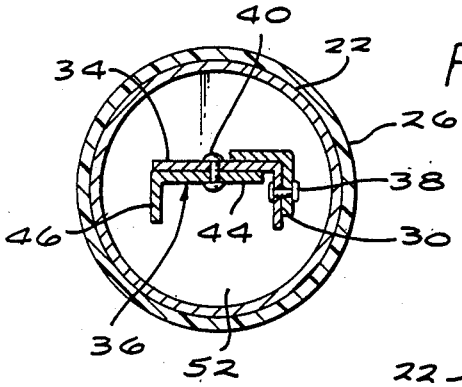
FIG. 8
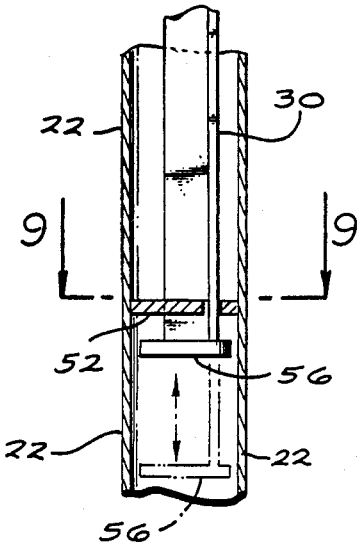
FIG. 9
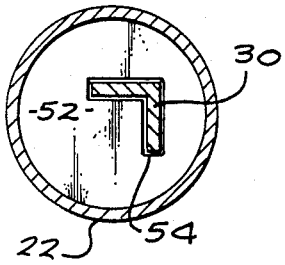
FIG. 10
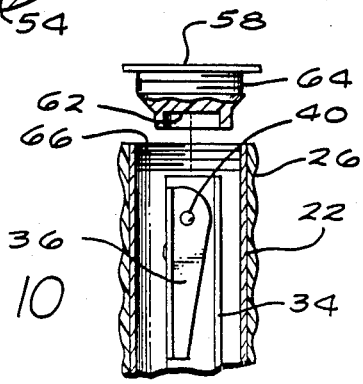

GOLF CLUB WITH INTERNAL SAND RAKE

BACKGROUND OF THE INVENTION

This invention relates generally to golf clubs and golfing equipment. More specifically, the invention relates to a collapsible sand rake assembly which may be stored within the shaft of a golf club, and selectively extended from an upper end of the club for use by a golfer.

As most golfers know, one of the hazards encountered on a golf course is the bunker or sand trap. Golf etiquette calls for the player to fill and smooth over his footprints and depressions left in the sand after he has hit a golf ball out of the bunker.

Either the player or his caddy attends to the necessary restoration of the bunker surface, generally with a bunker rake which is left alongside each bunker. Such bunker rakes, however, have a way of disappearing on golf courses and, apart from making a proper restoration of bunker surface extremely difficult, this has added to the cost of golf course operation.

Prior measures taken to cope with the situation include the provision of cheaply constructed bunker rakes, and the development of various types of fold-up rake devices that fit within the golfer's bag and small rake heads for temporary attachment to a golf club shaft. None of these prior approaches, however, have proven to be entirely satisfactory.

For example, in addition to the fact that the cheaply constructed bunker rakes have a tendency of breaking and thus have a very limited useful life, golfers tend to take such rakes away from the bunkers in order to retrieve golf balls from waterways and like inaccessible locations. Some inconsiderate golfers fail to return the borrowed rake to its proper location near the bunker. Further, many golfers often find the golf rakes provided by the golf course to be an unwanted obstacle to play, and when needed, in an inconvenient location. With regard to the devices heretofore developed to be carried by the golfer, whether they be of the fold-up rake variety or of the attachable rake head type, many golfers have been reluctant to carry the extra equipment required in the golf bag.

Accordingly, there has been a need for a novel sand rake assembly which can be used in connection with the types of golf clubs normally employed in bunkers, and which overcomes the drawbacks of prior devices. More particularly, a sand rake assembly is needed which can be stored within the shaft of a golf club, and extended therefrom for use when needed. Additionally, a golf club with an internal sand rake is needed which permits normal use of the club when the sand rake is not employed, and which is of high quality and economical construction. Moreover, such a sand rake assembly should be provided means for quick assembly and disassembly, to minimize any inconvenience to the golfer, and also to be of such construction that the club shaft itself can be used as an extension of the rake post. The present invention fulfills these needs and provides other related advantages.

SUMMARY OF THE INVENTION

The present invention resides in an improved golf club which can be used by a golfer in a normal manner when playing a ball out of a bunker, and then configured to provide a sand rake to level the sand in the bunker after play. The improved golf club includes a sand rake assembly which is normally stored within the shaft of the golf club, and is extendable therefrom when a sand rake is needed. Means are provided to secure the sand rake assembly within the golf club shaft in a manner which minimizes movement of the sand rake assembly within the shaft.

In a preferred form of the invention, the improved golf club includes a substantially hollow shaft having a first end connected to a club head, and a second openable end. The sand rake assembly is positioned within the shaft to be slidably extendable therefrom through the shaft second end. When positioned within the shaft, the sand rake assembly is held in a manner which minimizes movement with respect to the shaft, to permit normal use of the golf club.

The sand rake assembly includes a rake post and a rake head which is pivotally connected to one end of the post. The rake head includes a rake back which is the portion of the head pivotally connected to the post, and a plurality of tines which are pivotally connected to the rake back. The rake post, back and tines each have an angular construction for increased strength and rigidity.

The pivotable connection between the rake back and the rake post permits rotation of the head between an extended position wherein it lies generally perpendicular to the longitudinal axis of the post, and a retracted position wherein it lies generally parallel and adjacent to the post. Similarly, the plurality of tines are interconnected by means for moving the tines simultaneously between an extended position which is generally perpendicular to the longitudinal axis of the rake back, and a retracted position which is generally parallel and adjacent to the rake back. Thus, the rake post and the rake head may be suitably configured for placement completely within the golf club shaft, and then subsequently extended through the shaft second end and configured for use as a sand rake.

The means for moving the tines simultaneously between their extended and retracted positions includes a flexible cable which extends between and is attached to each tine. This cable permits a user to pull only one of the tines to the desired extended or retracted position, and likewise position all of the remaining tines. Moreover, means are provided for holding the tines in the extended position when the sand rake configuration of the golf club is desired. This holding means includes protrusions which extend from the rake back for frictionally engaging each tine in its extended position. This frictional engagement, however, may be overcome to place the tines back into their retracted position.

The means for securing the sand rake assembly within the golf club shaft includes means for positioning the end of the rake post opposite the rake head, within the golf club shaft. This positioning means includes a rake post guide fixed within the shaft, which has a cutout corresponding to the cross-sectional dimensions of the rake post. Means are provided on this end of the rake post to prevent a complete withdrawal of the sand rake assembly from the golf club shaft. This withdrawal prevention means includes a rake post stop which engages the rake post guide to limit the extension of the sand rake assembly through the second end of the golf club shaft.

Cap means are provided for engaging the rake head when the sand rake assembly is situated entirely within the golf club shaft. The cap means and the positioning means cooperate to securely hold the sand rake assembly within the shaft when normal use of the golf club is desired. The cap means is configured to close the shaft second end and includes a recess for holding an end of the rake head. In one embodiment, the cap means is tethered to the shaft and encloses the shaft second end by a plug-like friction fit. In another embodiment the cap means threadably engages the shaft second end to enclose the same.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is an enlarged, fragmented sectional view taken generally along the line 5—5 of FIG. 1, illustrating the collapsed configuration of the sand rake assembly within the shaft of the golf club;

FIG. 6 is an enlarged, fragmented sectional view similar to FIG. 5, illustrating the closure of a tethered cap over an open end of the golf club shaft;

FIG. 7 is an enlarged sectional view taken generally along the line 7—7 of FIG. 5;

FIG. 8 is an enlarged, fragmented sectional view taken generally along the line 8—8 of FIG. 1, illustrating the lower end of the rake post, and the manner in which it is positioned by a rake post guide within the shaft;

FIG. 9 is an enlarged sectional view taken generally along the line 9—9 of FIG. 8; and FIG. 10 is a fragmented sectional view similar to FIGS. 5 and 6, illustrating an alternative embodiment cap for closing the upper end of the golf club shaft.

DETAILED DESCRIPTION OF THE PREFERRED EMBODIMENT

Figure 1:
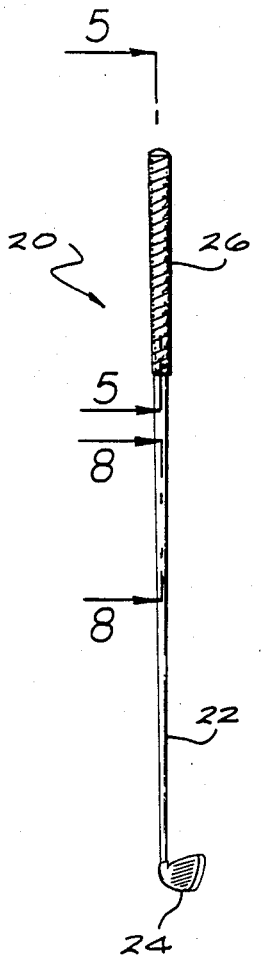
FIG. 1 is a an elevational view of a golf club embodying the present invention, illustrating the golf club when a sand rake assembly is completely retracted within the golf club shaft.
Figure 2:
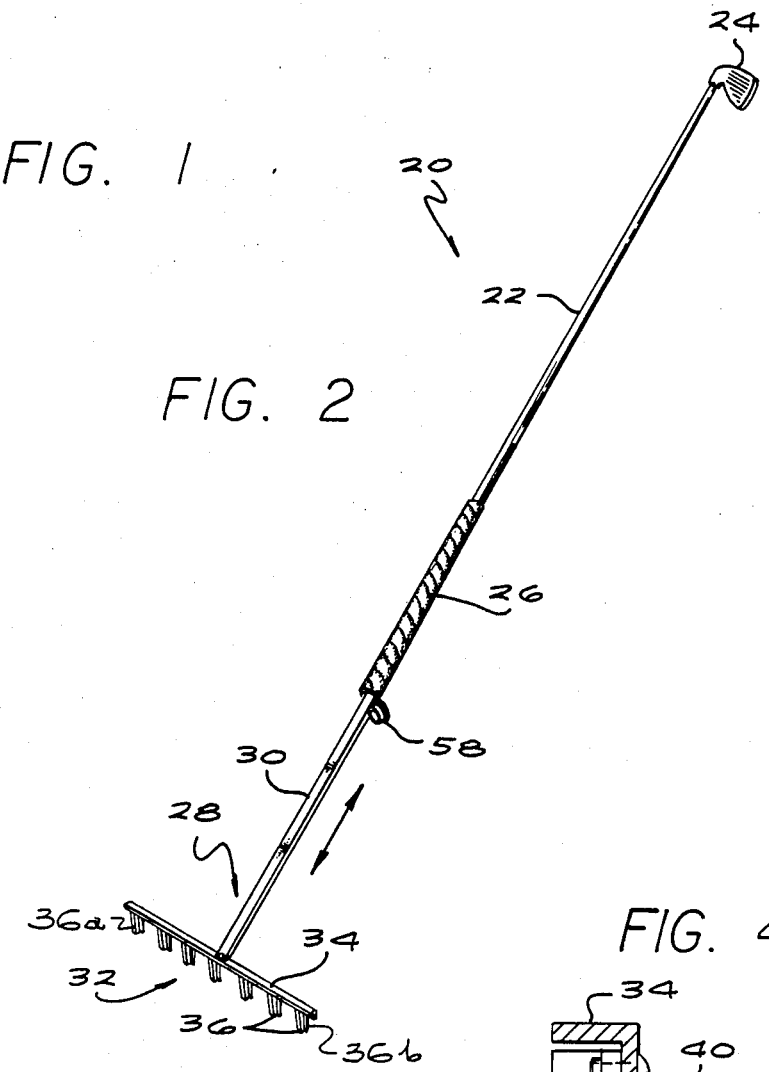
FIG. 2 is another perspective view of the golf club shown in FIG. 1, illustrating the configuration of the golf club when the sand rake assembly is fully extended.

As shown in the drawings for purposes of illustration, the present invention is concerned with an improved golf club, generally designated in FIGS. 1 and 2 by the reference number 20. This improved golf club 20 comprises a substantially hollow or tubular shaft 22 having a first end connected to a club head 24, and a second end which is surrounded by a handle 26. A sand rake assembly 28 is situated within the shaft 22 and may slidably extend through the shaft second end. The improved golf club 20, having the internal sand rake assembly 28, advantageously permits a golfer to conveniently store means for raking and smoothing sand in a bunker, within his bag without using additional space for a conventional rake. When the improved golf club 20 is a wedge or nine iron (those types of clubs typically used in bunker play), the golfer almost always has a rake with him when needed.

In accordance with the present invention, the sand rake assembly 28 includes a rake post 30 which is pivotally connected at one end to a rake head 32. As illustrated best in FIGS. 3 and 4, the rake head 32 includes a rake back 34 which is the portion of the rake head pivotally connected to the post 30, and a plurality of tines 36 which are each pivotally connected to the rake back. It is preferred that the post 30, the back 34 and the tines 36 each be constructed of an angled rod for increased strength and rigidity. The various components of the sand rake assembly 28 may be constructed of lightweight aluminum, plastic or other suitable material.

The rake back 34 is pivotable about a swivel connector 38 between an extended position (illustrated in FIGS. 2 and 3), wherein the rake back extends generally perpendicular to the post 30, and a retracted position (illustrated in FIGS. 5 and 7), wherein the back 34 lies generally parallel and adjacent to the post 30. Similarly, each tine 36 is connected to the back 34 by a pivot rivet 40. The tines 36 are rotatable about the pivot rivets 40 between an extended position which is generally perpendicular to the longitudinal axis of the back 34, and a retracted position wherein they lay generally parallel and adjacent to the back (see FIGS. 5 and 7).

When the post 30 is extended outwardly through the handle end 26 of the golf club shaft 22, and the components of the rake head 32 are placed in their extended positions (see FIGS. 2 and 3), the improved golf club 20 can be used as a sand rake by a golfer. The use of angular materials helps to hold the rake head components in their extended configuration when being used as a rake. In particular, the end of the post 30 which engages the back 34 includes a cutout section 42 (FIG. 3) whereat the swivel connector 38 is located. This cutout section 42 provides an abutment which limits rotation of the back 34 with respect to the post 30 to ninety degrees. Rotation of the back 34 to its retracted position is accommodated in the opposite direction so that a portion of the back lies immediately adjacent the post 30. In a similar manner, the tines 36 each have a primary face 44 and a perpendicular reinforcing rib 46. The primary face 44 has a rounded edge opposite the rib 46 to accommodate rotation of the tine 36 with respect to the back 34. Rotation to extend each tine 36 to its extended position is limited by engagement between the reinforcing rib 46 and the rake back 34.

Figure 4:
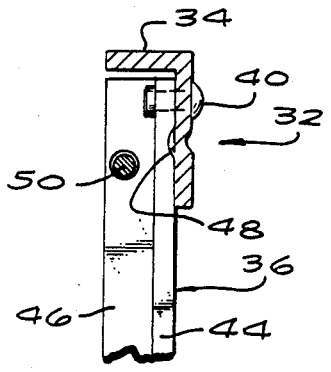
FIG. 4 is an enlarged, fragmented sectional view taken generally along the line 4—4 of FIG. 3, illustrating the manner in which the tines are held in their extended configuration with respect to the rake back by means of knob-like protrusions, and the manner in which a flexible cable extends through and is attached to each tine.
Figure 3:
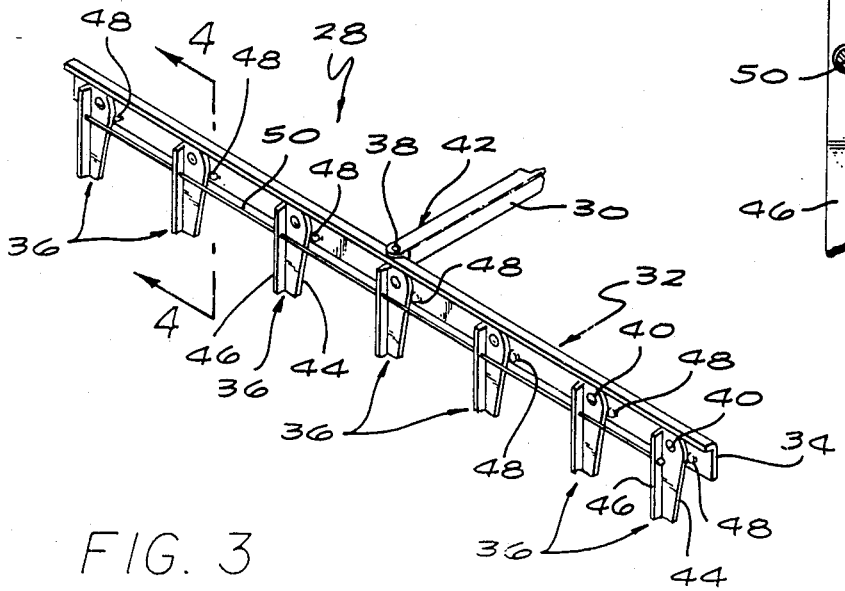
FIG. 3 is an enlarged, fragmented perspective view of the rake head illustrated in FIG. 2, illustrating a rake back extending from a rake post, and a plurality of tines extending from the rake back.

Additionally, small protuberances 48 are provided in the rake back 34 adjacent to each tine 36 to help frictionally hold the tine in its extended position. As shown in FIGS. 3 and 4, these protuberances 48 extend slightly outwardly and engage the edge of the primary face 44 of each tine 36. When the tines 36 are pulled into their retracted position, they are caused to ride up over each protuberance 48 in order to lie substantially parallel to the rake back 34.

The tines 36 are interconnected by means for moving the tines simultaneously between their extended position and the retracted position. This moving means comprises a flexible cable 50 which extends between and is attached to each of the tines. The cable 50 preferably extends through the reinforcing rib portion 46 of each tine 36 in a manner wherein extension of all tines 36 to their extended position is accomplished by simply extending a left-most tine 36a as viewed in FIG. 3. To retract all of the tines 36 simultaneously, the right-most tine 36b (as shown in FIG. 3) will simply be rotated in the opposite direction to pull, via the cable 50, all the tines to lie parallel and adjacent to the rake back 34.

When the tines 36 are retracted to lie parallel to the rake back 34, and the back is retracted to lie parallel to the post 30, the entire sand rake assembly 28 can be slidably inserted within the shaft 22 of the improved golf club 20. It is desirable that movement of the various components of the sand rake assembly 28 be minimized or altogether eliminated when the sand rake assembly is positioned within the shaft 22. This is accomplished, in part, by providing an internal rake post guide 52 which is fixed within the shaft 22. As shown best in FIGS. 8 and 9, the rake post guide 52 is provided a cutout 54 corresponding to the cross-sectional dimensions of the rake post 30. The effect of such construction is to permit the rake post 30 to slide through the rake post guide 52 without engaging the shaft 22.

In order to prevent the rake post 30 from being completely withdrawn from the shaft 22, a rake post stop 56 is fixed to the end of the post opposite the head 32. The extension of the sand rake assembly 28 through the handle end of the shaft 22 is limited by engagement between the stop 56 and the guide 52. Insertion of the sand rake assembly within the shaft 22 is also limited by the positioning of the rake post guide 52. In this regard, the guide 52 is preferably positioned within the shaft 22 so that as the lower end of the head 32 engages the guide 52, the upper end of the head is situated just inside the shaft 22, as shown in FIGS. 5, 6 and 10.

When the upper end of the head 32 is positioned as just described within the shaft 22, that end of the sand rake assembly 28 can be securely held within the shaft by means of a cap 58 configured for closing the second end of the shaft and for holding the rake head 32 in a manner which prevents its contact with the inner walls of the shaft. As illustrated in FIGS. 5 and 6, a first embodiment of the cap 58 is connected to the handle 26 by a tether 60, and includes a recess 62 which surrounds the adjacent end of the sand rake assembly 28. The cap 58 covers the open second end of the shaft 22 and is retained therein by a friction fit.

An alternative embodiment of the cap 58 is illustrated in FIG. 10. In that embodiment, the cap 58 still includes the recess 62 for engaging the adjacent end of the sand rake assembly 28, and also includes threads 64 which screw into corresponding internal threads 66 provided adjacent to the second end of the shaft 22. Thus, to securely position the sand rake assembly 28 within the shaft 22 so as to minimize contact between the sand rake assembly 28 and the shaft, the cap 58 is screwed into the internal threads 66.

In use, the sand rake assembly 28 would normally be configured in its retracted position and stored within the shaft 22 as illustrated in FIGS. 5 through 9. Since the components of the sand rake assembly 28 can be constructed of lightweight yet strong materials, the weight and balance characteristics of the golf club 20 can be maintained within desirable tolerances, without adversely affecting the golfer's play. Moreover, since the sand rake assembly 28 is carried within the improved golf club 20, no additional space is needed for storage of rakes or the like within the golfer's bag, and especially if incorporated into those types of clubs normally employed in bunker play, the golfer can have the rake with him always when needed.

In particular, should the golfer be so unfortunate as to have his ball land in a bunker, he would simply take his nine iron or wedge having the internal sand rake assembly, and play the ball as he normally would. When finished, he would remove the cap 58, pull the sand rake assembly 28 outwardly from the shaft 22, and then place the back 34 and the tines 36 in their extended configurations (FIG. 2). The golfer could then rake over his footprints and smooth the sand, without having to search for a possibly nonexistent bunker rake. The sand rake assembly can then be folded into its retracted position and stored once again within the shaft 22 of the improved golf club 20.

From the foregoing it is to be appreciated that the improved golf club 20 overcomes many of the drawbacks found in prior devices. More particularly, the sand rake assembly 28 is stored within the shaft 22 in a manner which permits normal use of the club when the sand rake is not deployed, and yet can be configured for use in a quick and simple manner. The rake post guide 52 and the cap 58 cooperate to securely hold the sand rake assembly within the shaft and minimize is movement relative to the shaft. In the embodiment shown, the shaft 22 itself provides an extension to the rake post 30.

Although a particular embodiment of the invention has been described in detail for purposes of illustration, various modifications may be made without departing from the spirit and scope of the invention. Accordingly, the invention is not to be limited, except as by the appended claims.

I claim:

1. A golf club, comprising:

a substantially hollow shaft having a first end connected to a club head, and a second end;

rake means positionable within the shaft and slidably extendable therefrom through the shaft second end, the rake means including a rake post having a first end and a second end, and a rake head pivotally connected to the first end of the rake post and having a plurality of tines for raking sand or the like, wherein the rake post and the rake head may be suitably configured for placement completely within the golf club shaft, and then subsequently extended through the shaft second end and configured for use as a rake; and means for positioning the rake means within the shaft to restrict movement of the rake means with respect to the shaft, the positioning means including means for guiding the second end of the rake post, and means for engaging the rake head when the rake means is situated entirely within the shaft, wherein the guiding means and the engaging means cooperate to securely hold the rake means within the shaft and minimize movement of the rake means with respect to the shaft.

2. A golf club as set forth in claim 1, wherein the rake head includes a rake back pivotally connected to the first end of the rake post, and wherein the plurality of tines are pivotally connected to the rake back.

3. A golf club as set forth in claim 2, wherein the plurality of tines are interconnected by means for moving the tines simultaneously between an extended position generally perpendicular to the longitudinal axis of the rake back, and a retracted position generally parallel and adjacent to the rake back.

4. A golf club as set forth in claim 3, wherein the means for moving the tines simultaneously includes a flexible cable extending between and attached to the plurality of tines.

5. A golf club as set forth in claim 2, wherein the rake post, the rake back and the tines each include an angular-type construction.

6. A golf club as set forth in claim 2, including stop means for holding the tines in an extended position generally perpendicular to the longitudinal axis of the rake back.

7. A golf club as set forth in claim 6, wherein the stop means includes protrusions extending from the rake back for engaging each tine to hold it in its extended position.

8. A golf club as set forth in claim 1, wherein the guiding means includes a rake post guide fixed within the shaft and having a cutout corresponding to the cross-sectional dimensions of the rake post, wherein the second end of the rake post slides through the rake post guide without engaging the shaft.

9. A golf club as set forth in claim 8, wherein the rake means includes a rake post stop fixed to the second end of the rake post, for engaging the rake post guide to limit extension of the rake means through the shaft second end.

10. A golf club as set forth in claim 8, wherein the engaging means comprises a cap configured for closing the shaft second end, wherein the cap includes a recess for holding an end of the rake head.

11. A golf club as set forth in claim 10, wherein the cap is tethered to the shaft and encloses the shaft second end by a plug-like friction fit.

12. A golf club as set forth in claim 10, wherein the cap threadably engages the shaft second end to enclose the same.

13. A golf club, comprising:

a tubular shaft having a first end connected to a club head, and a second end;

rake means situated within the shaft and slidably extendable therefrom through the shaft second end; and means for securing the rake means within the shaft.

14. A golf club as set forth in claim 13, wherein the rake means includes a rake post having a first end and a second end, a rake back pivotally connected to the first end of the rake post, and a plurality of tines pivotally connected to the rake back, each tine being pivotable between an extended position generally perpendicular to the longitudinal axis of the rake back, and a retracted position generally parallel and adjacent to the rake back, the rake tines and the rake back forming a rake head for raking sand or the like.

15. A golf club as set forth in claim 14, wherein the plurality of tines are interconnected by means for moving the tines simultaneously between their extended position and their retracted position.

16. A golf club as set forth in claim 15, wherein the means for moving the tines simultaneously includes a flexible cable extending between and attached to the plurality of tines.

17. A golf club as set forth in claim 16, including stop means for holding the tines in their extended position, the stop means including protrusions extending from the rake back for engaging each tine to hold it in its extended position.

18. A golf club as set forth in claim 14, including means for positioning the second end of the rake post within the golf club shaft, the positioning means including a rake post guide fixed within the shaft and having a cutout corresponding to the cross-sectional dimensions of the rake post, and means for engaging the rake head when the rake means is situated entirely within the shaft, wherein the positioning means and the engaging means cooperate to securely hold the rake means within the shaft and minimize movement of the rake means with respect to the shaft.

19. A golf club as set forth in claim 18, wherein the engaging means comprises a cap configured for closing the shaft second end, wherein the cap includes a recess for holding an end of the rake head.

20. A golf club as set forth in claim 13, including means for preventing the rake means from being withdrawn completely from the golf club shaft.

21. A golf club with an internal sand rake, comprising:

a tubular shaft having a first end connected to a club head, and a second end;

rake means anchored within the shaft and slidably extendable therefrom through the shaft second end, the rake means including:

a rake post having a first end and a second end, a rake back pivotally connected to the first end of the rake post, wherein the rake back is pivotable between an extended position wherein it lies generally perpendicular to the longitudinal axis of the rake post, and a retracted position wherein it lies generally parallel and adjacent to the rake post, a plurality of tines pivotally connected to the rake back, wherein the plurality of tines are pivotable between an extended position generally perpendicular to the longitudinal axis of the rake back, and a retracted position generally parallel and adjacent to the rake back, and stop means for holding the tines in their extended position;

means for positioning the second end of the rake post within the shaft, the positioning means including a rake post guide fixed within the shaft and having a cutout corresponding to the cross-sectional dimensions of the rake post, wherein the second en of the rake post slides through the rake post guide without engaging the shaft;

means for preventing the withdrawal of the rake means from the golf club shaft, including a rake post stop fixed to the second end of the rake post for engaging the rake post guide in a manner limiting extension of the rake means through the shaft second end; and cap means configured for closing the shaft second end, including a recess for holding an end of the rake head, wherein the positioning means and the cap means cooperate to securely hold the rake means within the shaft and minimize movement of the rake means with respect to the shaft.

22. A golf club as set forth in claim 21, including means for moving the tines simultaneously between their extended position and their retracted position.

23. A golf club as set forth in claim 21, wherein the stop means includes protrusions extending from the rake back for engaging each tine to hold it in its extended position.

* * * * *